US005696494A

United States Patent [19]

Chen

[11] Patent Number: 5,696,494

[45] Date of Patent: Dec. 9, 1997

[54] ROTARY UNIT AND ILLUMINATION UNIT FOR A 3-SIDE VARIABLE ADVERTISEMENT DISPLAY BOARD

[76] Inventor: Chih-Tsung Chen, No. 47, Min-chung Rd., Lu Kang Chen, Changhua Hsien, Taiwan

[21] Appl. No.: 743,074

[22] Filed: Nov. 4, 1996

[51] Int. Cl.[6] ..... G08B 5/00

[52] U.S. Cl. ..... 340/815.4; 340/815.69; 40/473; 40/493; 40/502; 40/503; 116/286

[58] Field of Search ..... 340/815.4, 815.69, 340/815.83, 332, 908.1; 40/493, 503, 506, 502, 473, 593; 116/202, 286, 284, 299

[56] References Cited

U.S. PATENT DOCUMENTS

| | | | |
|---|---|---|---|
| 3,918,183 | 11/1975 | Poulos | 40/473 |
| 4,002,022 | 1/1977 | Lopez | 368/227 |
| 4,182,059 | 1/1980 | Greene | 40/377 |
| 4,558,529 | 12/1985 | Chang et al. | 40/473 |
| 5,003,716 | 4/1991 | Dyar | 40/503 |
| 5,046,274 | 9/1991 | David | 40/604 |
| 5,297,353 | 3/1994 | Ghalayini | 40/503 |
| 5,315,776 | 5/1994 | Strawbridge et al. | 40/505 |

*Primary Examiner*—Jeffery Hofsass
*Assistant Examiner*—Davetta Woods
*Attorney, Agent, or Firm*—Bacon & Thomas

[57] ABSTRACT

A rotary unit and illumination unit for a 3-side variable advertisement display board is disclosed. It has a frame made up of a lower groove and two lateral hollow tubes and fixed to a supporting leg by welding. Light tubes are fixed inside triangular hollow columns by rubber pads screwed to an upper member. A cross-head shaft passing through the worms of a worm gear disposed inside a lower supporting member and connected to a rectangular axle on top of the lower supporting member, is joined to a gearing wheel which driven by a driving wheel actuated by a motor, will cause the movement of the cross-head shaft, resulting in the rotation of the triangular hollow columns. An ultra-red ray sensor is used to signal the stop movement of the triangular hollow columns, a timer and a rectifier are used to preset and control the regular movement of the triangular hollow columns. Consequently, the advertisements displayed on the three faces of the triangular columns can be displayed completey in turns as a result of the regular movement of the triangular hollow columns.

2 Claims, 5 Drawing Sheets

40
41
42
41
A-A
A
40
71
70
A
41
72
74
14
10
24
23
21
20
14
22
71
74
61
612
615
614
611
73
72
70
614
613
13
13
61
90
60
64
131
12
631
63
95
60
623
622
62
621
50
50
56
51
30
93
94
55
53
53
52
54
31
91
92
551
54
11
32
811
80
81

ROTARY UNIT AND ILLUMINATION UNIT FOR A 3-SIDE VARIABLE ADVERTISEMENT DISPLAY BOARD

BACKGROUND OF THE INVENTION

The present invention relates to a rotary unit and illumination unit for a 3-side variable advertisement display board, comprising a frame, a supporting leg, an upper cover, an upper member, a lower member, a plurality of lower supporting means, three-face triangular hollow columns, upper engaging heads, lower engaging heads, and several bushings and transparent sleeves, light tubes, and rubber pads, a cross-head shaft, a gearing wheel, a motor, a transmission gear box, a rectifier, a timer, and an ultra-red ray sensor. By the assembly of the above means and the driving of the motor, the display board can rotate regularly to demonstrate three different fascinating advertisements on the three faces of the triangular hollow columns.

Please refer to FIG. 1. A conventional advertisement display board is mainly made up of a frame 10, a supporting leg 101, several light tubes 102 and two acrylic boards 103 (whereon advertising words or figures are displayed). The supporting leg 101 is secured to the bottom of the frame 10 by welding. And the light tubes 102 are fixed inside the frame 10. Two acrylic boards 103 are then placed on both front and rear sides sandwiching the light tubes therebetween and secured to the edges of the frame 10 by screws. Yet, there are several drawbacks associated with the above conventional advertisement display board. First, only one fixed set of advertisement can be displayed on the board whose lack of change makes such advertisement relatively too simple and even boring. For another, more display boards are required to display different advertisements which will occupy a lot of space and make the limited space in a business spot inadequate.

SUMMARY OF THE INVENTION

It is, therefore, the primary object of the present invention to provide a rotary unit and illumination unit for a 3-side variable advertisement display board, which can be located randomly and can variably disply three different advertisements in turns so as to enhance the efficiency of advertisement as well as to reduce the space of the conventional advertisement display board.

DETAILED DESCRIPTION OF THE PREFERRED EMBODIMENT

Figure 1:
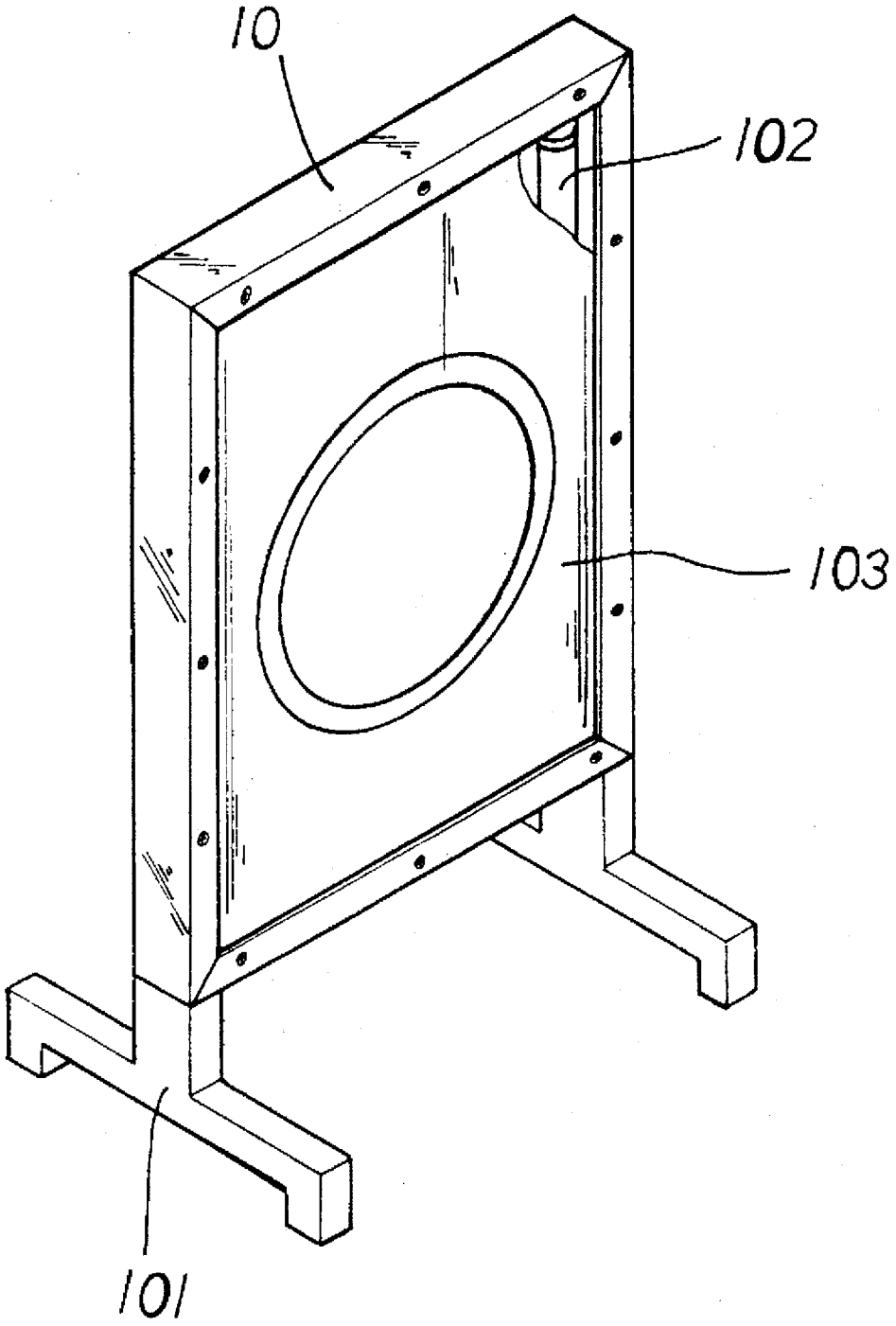
FIG. 1 PRIOR ART
FIG. 1 is a perspective assembled view of a conventional advertisement display board.
Figures 2, 2A:
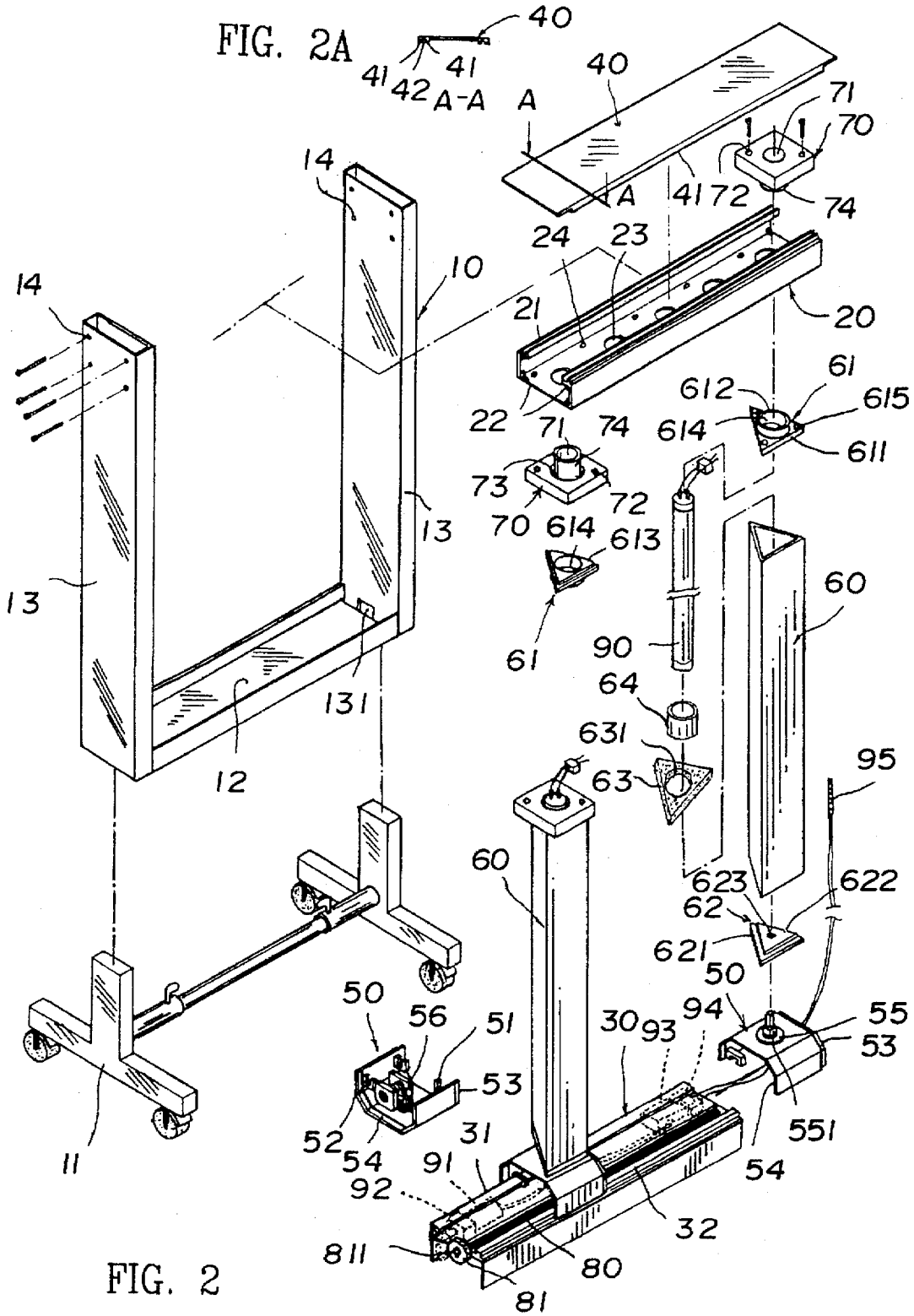
FIG. 2 is a perspective exploded view of the present invention.
FIG. 2A is a sectional veiw of the present invention taking along A—A.

Please refer to FIG. 2. The present invention relates to a rotary unit and illumination unit for a 3-side variable advertisement display board, comprising a frame 10, a supporting leg 11, an upper member 20, a lower member 30, an upper cover 40, a plurality of lower supporting means 50, triangular hollow columns 60, upper engaging heads 61, lower engaging heads 62, several bushings 63 and transparent sleeves 64 and rubber pads 70, a cross-head shaft 80, a gearing wheel 81, several light tubes 90, a motor 91, a transmission gear box 92, a rectifier 93, a timer 94, and an ultra-red ray sensor 95 (or by a contact switch).

The frame 10 is made up of a lower groove 12 and two lateral hollow tubes 13 provided with four through holes 14 at both upper inner side corresponding one to another and a wire outlet 13 at one bottom inner side. The upper member 20 is U-shaped, having two top flanges extending inwardly for a short distance from the top edge of the upper member 20 thereof and two rib flanges 21 extending upwardly on top of each top flange.

Both ends of the upper member 20 are provided with four C-shaped engaging blocks 22 at the four corners thereof and the bottom floor of the upper member 20 are several big circular holes 23 disposed at proper intervals along with several screw holes 24 arranged in opposite angle at both lateral sides of the big circular holes 23. The upper cover 40 has two longitudinal ribs 41 extending downwardly at both edges between which are formed a groove 42 as shown in FIG. 2A.

The lower member 30 is inverted U-shaped, having a big longitudinal dovetail track 31 and a small longitudinal dovetail track 32 disposed respectively at both lateral sides on the top face of the lower member 30. The lower supporting means 50 are arch-shaped, each having a pair of big protruding lugs 51 provided with big dovetail groove and a pair of small protruding lugs 52 provided with small dovetail groove disposed at both lateral walls of the underside. And an outer joint flange 53 and an inner joint flange 54 each defined a proper width are disposed at both ends of the supporting means 50 thereof.

An axle block 55 combined with a rectangular axle 551 on top centers the upside of the lower supporting means 50 while a worm gearing 56 joined to the rectangular axle 551 is disposed on the underside of the lower supporting means 50 thereof.

The three faces of the three lateral sides of the triangular hollow column 60 can be used to display advertising words or figures (three different advertisements at the same time on the three faces to form a three-dimensional advertising display boards).

The upper engaging, head 61 is formed by a big triangular member 611 provided with a round protruding column 612 at the top and a triangular protruding block 613 at the bottom. A circular through hole 614 is disposed at the protruding column 612 and sensory iron plates 615 are embedded each at the three top corners of the big triangular member 611 respectively. The lower engaging head 62 is formed by another big triangular member 621 provided with a triangular protruding block 622 and a rectangular axle hole 623 at the center of the triangular protruding block 622 thereof.

The bushings 63 are made of semi-flexible rubber and is of a flat triangular shape with a through hole 631 disposed at the center thereof. The sleeves 64 are a hollow transparent and heat-resistant tubes each having an outer diameter slightly larger than the, inner diameter of the through hole 631 of each triangular bushing 63.

The rubber pad 70 is centered with a tap hole 71 at the upside with two through holes 72 disposed at the two top corners in opposite angle respectively. A round groove 73 along with an engaging sleeve 74 extending downwardly from the interior of the round groove 73 and connected with the tap hole 71 defines the center section at the underside of the rubber pad 70. The cross-head shaft 80 is sectionally crossed in shape, while a cross hole 811 is provided at the center of the gearing wheel 81.

Figure 3:
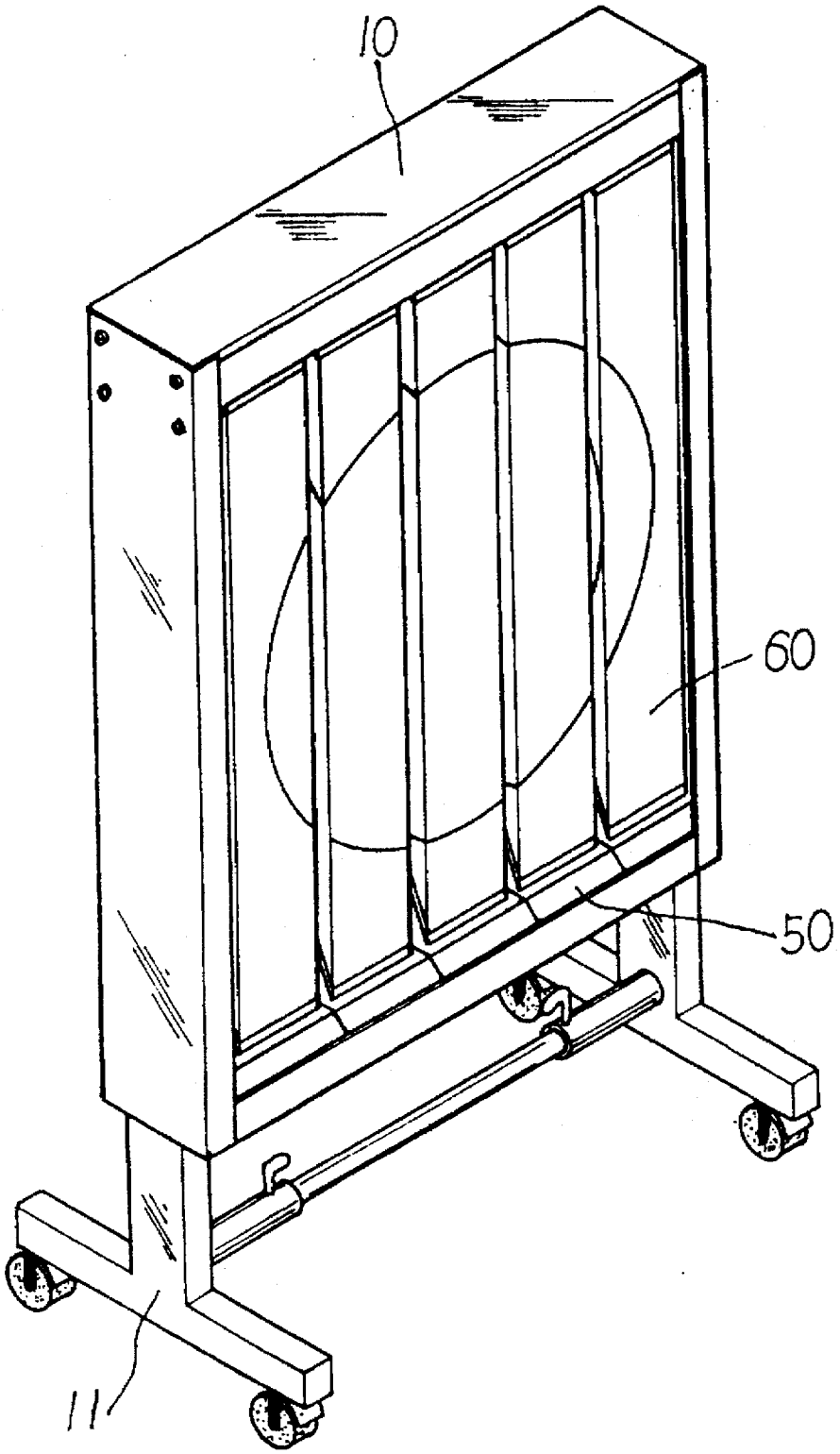
FIG. 3 is a perspective assembled view of the present invention.
Figure 4:
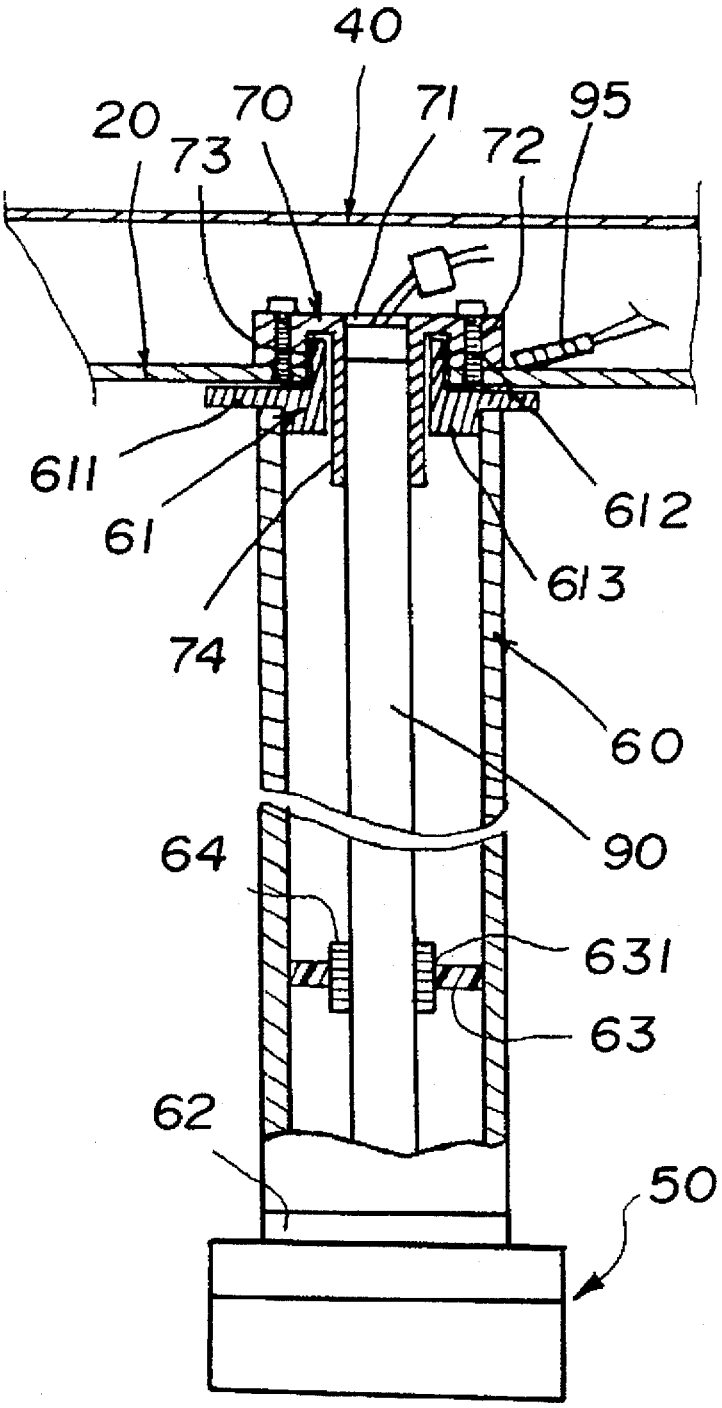
FIG. 4 is a partially sectional veiw of the present invention in assembly.

Please refer to FIGS. 3 and 4. In assembly, the supporting leg 11 is first attached to the bottom of the lower groove 12 of the frame 10 by welding. The rectifier 93, timer 94, motor 91 and transmission sear box 92 connected and linked to electricity are fixed at one side on the upside of the lower member 30.

Then the lower supporting means 50 are attached to the lower member 30 by engaging respectively the big and small dovetail grooves of the big and small protruding lugs 51, 52 disposed on the lower supporting means 50 with the big and small longitudinal dovetail tracks 31, 32 disposed on the lower member 30. Furthermore, the lower supporting means 50 are joined each to the other by means of the outer joint flange 53 corresponding to the inner joint flange 54. The transparent sleeve 64 is engaged with the through hole 631 of the triangular bushing 63 and then the bushing 63 is slightly forced into engagement with the top end of one triangular hollow column 60. The triangular protruding blocks 622 of the lower engaging heads 62 are then inserted into the bottom ends of the triangular hollow columns The rectangular axle 551 on the axle block 55 of the lower supporting means 50 can be jointed to the rectangular axle hole 623 of the lower engaging heads 62. The cross-head shaft 80 is then passed through the worms of the worm gearings 56 disposed inside the lower supporting means 50, connecting and aligning the lower supporting means 50 thereof and joined to the cross hole 811 of the gearing wheel 81 at one end. The gearing wheel 81 is further conjoined to a driving wheel disposed at one lateral side of the transfer wheel case 92.

The triangular protruding blocks 613 of the upper engaging heads 61 are likewise inserted into the top end of the triangular hollow columns 60. And the rubber pads 70 are placed and screwed onto the upper member 20, with the tap holes 71 of the rubber pad 70 corresponding to the big circular holes 23 of the upper member 20 and the through holes 72 of the rubber pad 70 corresponding and attached to the screw grooves 24 on the upper member 20 by screws.

The protruding columns 812 of the upper engaging heads 61 are led through the big circular holes of the upper member 20 and engaged within the round grooves 73 of the rubber pads 70 without abutting tightly against the walls of the round grooves 73, permitting the triangular hollow columns to move freely within the grooves 73 thereof.

The engaging sleeves 74 of the rubber pads 70 are passed through the circular through holes 614 of the upper engaging heads 61 into the interior of the triangular hollow columns 60, also without direct contact with the through holes 614 thereof. The upper end of the light tubes 90 can then be inserted into the tap holes 71 and the engaging sleeve 74 of the rubber pads 70 with only the top end of the light tubes 90 emerged as shown in FIG. 4. The lower end of the light tube 90 is inserted into the tubular sleeve 64 of the triangular bushing 63 housed in the triangular hollow column 60, securely retaining the light tube in place when the triangular hollow column 60 is horizontally placed. Besides, the transparent sleeve 64 and the light tube 90 both have a smooth surface so that they will not frictionally interfere with each other.

The head of the light tubes 74 can be coupled to electricity. And the ultra-red ray sensor 95 can be connected with the timer 94 by wires running through the lateral hollow tube 13 of the frame 10 and going out from the wire outlet 131 of the tube 13 thereof. The ultra-red ray sensor 95 is fixed in the interior bottom floor of the upper member 20, just above one of the sensory iron plates 615 embedded on the upper engaging heads 61.

The upper cover 40 can be assembled to the upper member 20 by engaging rib flanges 21 disposed on the top flanges of the upper member 20 with the groove 42 formed by the two longitudinal ribs 41 disposed on the lateral edges of the upper cover 41 (so that the light tubes 90 can easily be changed from this spot). The whole assembly memtioned so far can then be placed and secured within the frame 10 by screws passing through the four through holes 14 disposed on both upper lateral side of the frame 10 and the C-shaped engaging blocks 22 of the upper member 20 to complete the construction of the present invention.

Figure 5:
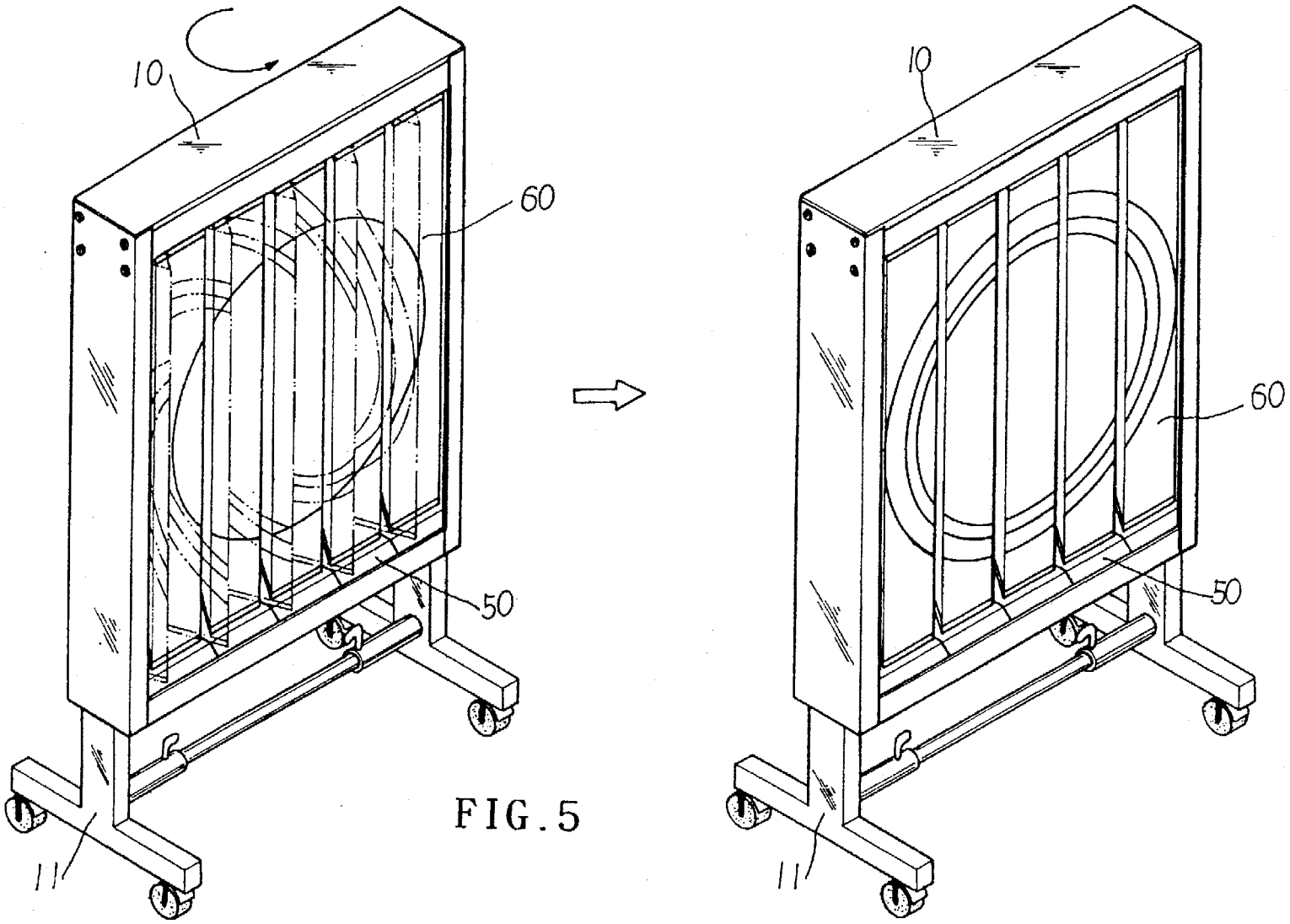
FIG. 5 is an operational view of the present invention in motion.

Please refer to FIG. 5. When power is switched on, the motor 91 will activate the movement of the driving wheel disposed on the lateral side of the transfer wheel case 92, causing the rotation of the gearing wheel 81 which in turn will move the cross-head shaft 80 attached to the cross head 811 of the gearing wheel 81.

The movement of the cross-head shaft 80 led through the worms of the worm gearings 56 of the lower supporting means 50 will activate the movement of the rectangular axles 551 of the lower supporting means 50 attached to the triangular hollow columns 60 by means of the lower engaging heads 62, thus causing the rotation of the triangular hollow columns 60. When one of the sensory iron plate 615 embedded on the top upper engaging head 61 approaches the ultra-red ray sensor 95 at the bottom floor of the upper member 20, the ultra-red ray sensor will send out a signal to the timer 94 and the rectifier 93 disposed at the lower member 30 to cut off the electricity of the motor 91.

Thus all the movements of the driving wheel disposed at one side of the transmission gear box, the gearing wheel 81, and the cross-head shaft 80 as well as the gearing worms 55 and the rectangular axle 551 of the lower supporting means 50 rotating the triangular hollow columns, are stopped.

The movable advertisement display board will stop rotating for moments to display advertisements from both sides (the time for the display board to stop can be preset by the timer 94). When the timer 94 and the electric controller 93 recover the electricity of the motor 91, the triangular hollow columns 60 will continue to rotate till the next sensory iron plate 615 embedded on the top upper engaging heads 61 thereof approaches the ultra-red ray sensor 95 which, as stated above, will send a signal to the timer 94 and the electric controller 93 that will ultimately stop the movement of the triangular hollow columns 60 till the next circling. Consequently in a regular cylce of stop and motion, the advertisements displayed on the three faces of the triangular hollow columns 60 will be shown vividly and completely by turns to enhance the efficiency of advertisement as well as to reduce the space required for more advertisement display boards.

What is claimed is:

1. A rotary unit and illumination unit for 3-side variable advertisement display board, comprising a frame, a supporting leg, an upper member, a lower member, an upper cover, a plurality of lower supporting means, triangular hollow columns, upper engaging heads, lower engaging heads, bushings, transparent sleeves, light tubes, and rubber pads, a cross-head shaft, a gearing wheel, a motor, a transmission gear box, a rectifier, a timer, and a ultra-red ray sensor; wherein:

the frame has a lower groove and two lateral hollow tubes having four through holes corresponding one to another at both upper section respectively and a wire outlet at one bottom end;

the upper member is U-shaped, having two top flanges extending inwardly for a short distance from the top edge thereof and two rib flanges extending upwardly on top of each top flanges; four C-shaped engaging blocks disposed at the four corners on both ends of said upper member corresponding to the through holes of the frame; several big circular holes disposed at proper intervals and several screw holes arranged in opposite angle;

the upper cover is sheet-shaped, having two longitudinal ribs extending downwardly at both edges forming a groove therebetween to engage with said rib flanges of said upper member;

the lower member is inverted U-shaped, having a big longitudinal dovetail track and a small longitudinal dovetail track disposed respectively at both lateral sides on the top floor;

the lower supporting means are arch-shaped, each having a pair of big protruding ear provided with big dovetail groove and a pair of small protruding hlugsprovided with small dovetail groove disposed at both inner lateral sides, an outer joint flange and an inner joint flange each defining a proper width at both ends, an axle block combined with a rectangular axle on the top center and a worm gearing on the underside;

the triangular hollow column forms three surfaces on the three lateral sides on which advertising words or figures can be displayed (three different advertisements at the same time on the three surfaces);

the upper engaging head is formed by a big triangular member having a round protruding column disposed with a circular through hole at the top, a triangular protruding block at the bottom and three sensory iron plates embedded at the three corners of the top face;

the lower engaging head is formed by another big triangular member having a triangular protruding block centered by a rectangular axle hole at the top;

each bushing is made of semi-flexible rubber in a flat triangular shape with a through hole at the center thereof;

each transparent sleeve is a heat-resistant hollow tube with the external diameter slightly larger than the diameter of the through hole of said bushing;

the rubber pad is provided with a tap hole at the center of the upside, two through holes at the two corners in opposite angle and a round groove having an engaging sleeve extending downwardly from the interior of said round groove to connect with said tap hole;

the cross-head shaft has a cross section, engaged at one end with the cross hole disposed at the gearing wheel and at the other with the worms of the worm gearings;

whereby, in assembly, the supporting leg is attached to the frame by welding, and the rectifier, timer, motor and transmission gear box, connected and linked to electrical power, are fixed at one side on the upside of said lower member; the lower supporting means are attached to the lower member by enagaging the big and small dovetail grooves of the big and small protruding lugs interior of said lower supporting means onto the big and small longitudinal dovetail tracks of said lower member while the lower supporting meanas are joined each to the other with the outer joint flanges corresponding to the inner joint flanges; each transparent sleeve is engaged with the through hole of each bushing flexibly secured inside the triangular hollow column; the triangular hollow columns can be attached to the lower supporting means by means of the lower engaging heads whose rectangular axle holes are jointed to the rectangular axles disposed on the, axle blocks on top of said lower supporting means, and to said upper member by means of the upper engaging heads; the upper end of each light tube is fixed inside the triangular hollow column by means of said rubber pad screwed to said upper member and the lower end of the light tube is inserted into the transparent sleeve engaged with the bushing housed in the triangular hollow column so as to firmly retain the light tube in position when the triangular hollow column is horizontally placed; the cross-head shaft, activated by the gearing wheel driven by the driving wheel at one side of the transmission gear box, will result in the circling of the triangular hollow columns; the ultra-red ray sensor is used to signal the stop movement of said triangular hollow columns, and the timer and the rectifier are to preset and control the movement of said columns; therefore, the advertisements displayed on the three faces of said columns will be shown completely in turns in the regular rotation.

2. The rotary unit and illumination unit for the 3-side variable advertisement display board according to claim 1, wherein said ultra-red ray sensor can be replaced by a contact switch.

* * * * *